US010934662B2

(12) United States Patent
Eryilmaz et al.

(10) Patent No.: US 10,934,662 B2
(45) Date of Patent: Mar. 2, 2021

(54) PROCESS FOR THE PRODUCTION OF A DYED FABRIC USING ENZYME AGGREGATES

(71) Applicant: Sanko Tekstil Isletmeleri San. Ve Tic. A.S., Inegol-Bursa (AR)

(72) Inventors: Jitka Eryilmaz, Inegol-Bursa (FR); Onur Yukselen, Inegol-Bursa (FR); Ozgur Cobanoglu, Inegol-Bursa (FR); Erdogan Baris Ozden, Inegol-Bursa (FR); Ertug Erkus, Inegol-Bursa (FR); Estera Szwajcer Dey, Lund (SE); Cedric Dicko, Lund (SE); Alixander Perzon, Lund (SE)

(73) Assignee: Sanko Tekstil Isletmeleri San. Ve Tic. A.S., Inegol-Bursa (TR)

( * ) Notice: Subject to any disclaimer, the term of this patent is extended or adjusted under 35 U.S.C. 154(b) by 0 days.

(21) Appl. No.: 15/484,859

(22) Filed: Apr. 11, 2017

(65) Prior Publication Data

US 2017/0298565 A1 Oct. 19, 2017

Related U.S. Application Data

(63) Continuation-in-part of application No. PCT/EP2016/058155, filed on Apr. 13, 2016.

(51) Int. Cl.

| | |
|---|---|
| ***D06L 4/40*** | (2017.01) |
| ***D06M 16/00*** | (2006.01) |
| ***D06P 5/13*** | (2006.01) |
| ***D06P 5/15*** | (2006.01) |
| ***D06P 3/60*** | (2006.01) |

(52) U.S. Cl.

CPC ..... *D06L 4/40* (2017.01); *D06M 16/003* (2013.01); *D06P 3/6025* (2013.01); *D06P 5/137* (2013.01); *D06P 5/158* (2013.01)

(58) Field of Classification Search

CPC . D06L 4/40; D06P 5/137; D06P 5/158; D06P 3/6025; D06M 16/003

See application file for complete search history.

(56) References Cited

U.S. PATENT DOCUMENTS

| | | | | | |
|---|---|---|---|---|---|
| 5,254,283 | A * | 10/1993 | Arnold | C11D 3/3715 | 427/213 |
| 7,311,926 | B2 * | 12/2007 | Grate | C12N 11/06 | 424/400 |
| 2008/0296231 | A1 | 12/2008 | Schoevaart | | |
| 2012/0149082 | A1 * | 6/2012 | Schoevaart | C12N 9/96 | 435/188 |
| 2013/0219635 | A1 * | 8/2013 | Schoots | D06P 5/137 | 8/552 |
| 2015/0038042 | A1 * | 2/2015 | Erkus | D03D 13/004 | 442/203 |

FOREIGN PATENT DOCUMENTS

| | | | | |
|---|---|---|---|---|
| WO | 9701629 | | 1/1997 | |
| WO | WO 97/01629 | * | 1/1997 | C12N 9/42 |
| WO | 9828411 | | 7/1998 | |
| WO | WO 98/28411 | * | 7/1998 | C12N 9/42 |

OTHER PUBLICATIONS

Podrepšek et al. (2012), Chemical Engineering Transactions: 27, 235-240.

International search report dated Dec. 5, 2016 for PCT/EP2016/058155.

International search report dated Jun. 2, 2017 for corresponding PCT/EP2017/058772.

European search report dated Jun. 6, 2017 for corresponding European application 17166222.4.

International Preliminary Report on Patentability dated Oct. 25, 2018 for corresponding international application No. PCT/EP2017/058772.

* cited by examiner

*Primary Examiner* — Amina S Khan

(74) *Attorney, Agent, or Firm* — Silvia Salvadori

(57) ABSTRACT

Provided is a process for the production of a dyed fabric using enzyme aggregates. In particular, provided is a process that comprises a step of providing a woven fabric that comprises a base layer and an additional layer which is located on at least one side of the fabric, wherein the yarns of the additional layer comprise fibers that are at least partially dyed, and a step of contacting the woven fabric with enzyme aggregates such as cross-linked enzyme aggregates (CLEAs), to remove at least part of the dye from at least the yarns of said additional layer. The disclosure also provides a fabric obtained with the process and garments including the fabric.

15 Claims, 10 Drawing Sheets

1= First weft yarns

2= Second weft yarns

PROCESS FOR THE PRODUCTION OF A DYED FABRIC USING ENZYME AGGREGATES

RELATED APPLICATION

This application is a continuation-in-part of, and claims priority to, international application PCT/EP2016/058155, filed 13 Apr. 2016 and which designates the US, the contents of which are hereby incorporated by reference as if set forth in their entirety.

TECHNICAL FIELD

The present invention relates to a process for the production of a woven fabric having a worn-out appearance, to a fabric obtained with the process and to garments including the fabric. In particular, the present invention relates to a process for producing a fabric and an article including a fabric having a "used" or "worn-out" appearance. The process uses enzymes aggregates such as cross-linked enzymes aggregates (CLEAs).

BACKGROUND

Worn out fabrics, especially denim, have enjoyed popularity in fashion industry due in particular to the finishing processes that can be applied to the fabric in order to create different appearances and thus different visible effects on the front side of the fabric, i.e. on the surface that is visible when the article made by the fabric is worn. In fact, the success in denim industry largely depends on creativity coming from a variety of fabric finishing processes that gives the fabric unique appearance and look.

The exterior appearance of the fabric, and thus of the clothing article made by the fabric, can be modified by using different finishing techniques.

A "used" or "vintage" or "worn-out" look of the fabric can be achieved by treating the fabric with a finishing process that is generally carried out on the garment or on the fabric. The known finishing processes may use specific chemicals, or mechanical abrasion, such as processes using stonewashing, acid wash, laser treatment and sandblasting. For example, in the stone washing, the fabric is washed in a cylinder in the presence of pumice stones. While the wash cylinder rotates, the fabric is contacted by the stones that will remove part of the yarn fibers including the dye present on the fibers.

In this case, when a fabric and, in particular, an indigo dyed woven fabric is used, wherein the indigo dye is located on the surface of the yarns leaving the core of the yarns undyed, a stone wash (or sand blast) finishing process can be applied to allow varying amounts of the undyed cores of the indigo yarns to become visible.

WO 98/28411 discloses a modified cellulase protein which is used in the treatment of textiles, e.g. in stonewashing of the textiles to produce a worn and faded look.

Particularly, WO 98/28411 discloses a method for treating a cellulose containing fabric comprising the steps of (a) forming an aqueous solution comprising a cellulase composition which differs from a precursor cellulase in that it has been enlarged, i.e. that has been manipulated to increase its mass (molecular weight), surface area or spatial volume, and (b) contacting the aqueous solution with a cellulose containing fabric for a time and under conditions appropriate to treat the fabric.

US 2008/0296231 discloses a method for the preparation of cross-linked enzyme aggregates, which comprises the following steps: i. generating aldehyde groups on enzyme molecules that may or may not be dissolved in a suitable solvent; ii. precipitating the enzyme molecules using a suitable precipitation agent; iii. cross-linking the precipitated enzyme molecules provided with aldehyde groups, using an amine composition, yielding cross-linked enzyme aggregates with improved properties, in particular improved activity and colloidal behaviour.

All the above-mentioned finishing treatments allow to obtain different visible effects, in particular worn appearance, which makes the fabric fashionable in the clothing and textile industries.

However, the visible effects and appearances that can be obtained by the known finishing treatments are limited. For example, in a finished fabric, the worn-out appearance, is essentially due to the amounts of the undyed cores of the indigo yarns made visible; therefore, the difference between one product having worn-out appearance and another one is the overall "color shade" of the product, i.e. how much a product having worn appearance is "faded" with respect to the other product.

Therefore, clothing articles made by different producers can be similar one to another, thus reducing the commercial desirability of the product and the possibility to distinguish a product from those of another producer.

Another problem is the fact that it is difficult to control the degree of removal of fibers from the fabric during the known finishing process; conventional abrasion-based methods always significantly decrease the mechanical integrity of the fabric, hence lowering tensile strength of treated fabrics and garments.

SUMMARY

It is an aim of the present invention to solve the above-mentioned problems and to provide a process for the production of a fabric having an improved worn-out appearance, in particular a distinctive worn-out appearance previously not obtainable with known methods.

Another aim of the present invention, is to provide a process for the production of a fabric having a worn-out appearance which is commercially desirable, recognizable and readily distinguishable from other products.

These and other aims are achieved by a process according to the claims, for the production of a woven fabric and the woven fabric and garments so produced and as claimed. In the following description, reference is made to the process being carried out on a fabric; this definition includes the fabric present in an article, especially a garment or clothing article. In other words, process claims are directed to a process that is carried out on a fabric independently on the form of the fabric. An article, e.g. a garment, that comprises or that is made with the fabric is included in the scope of protection of the claims of this application. Thus, claim 1 protects a process for bio-stoning a fabric having the specified additional layer, independently on the form of the fabric: treatment of a fabric which has already been made into an article falls within the scope of the present claims as well as the treatment of a fabric just obtained from the weaving process.

In particular, the present invention relates to a process for the finishing of a woven fabric comprising the following steps:

a. providing a woven fabric comprising warp yarns and weft yarns woven together to form a base layer of the fabric, and wherein a plurality of warp yarns and/or a plurality of weft yarns form a plurality of over portions of yarns forming at least one additional layer of the fabric, the additional layer being located on at least one side of the fabric, wherein the yarns of the additional layer comprise fibers that are at least partially dyed;

b. contacting the woven fabric with enzyme aggregates, to at least partially remove dye from at least the yarns of the additional layer.

In fact, it has been surprisingly observed that by providing a woven fabric according to step a of the process, and treating it (i.e. contacting it) with enzyme aggregates such as cross-linked enzyme aggregates (CLEAs), a fabric with an improved aesthetical effect can be obtained. The obtained fabric has a "three-dimensional" stone-washed effect, namely a "three-dimensional" worn-out appearance, previously not available through known finishing processes.

According to an embodiment of the invention, a plurality of weft yarns of the woven fabric is at least partially dyed, thus providing, on at least one side of the fabric, an additional layer which is in turn at least partially dyed.

The process according to the invention advantageously allows to remove the dye mainly from the additional layer on the front side of the fabric, without substantially affecting the underlying base layer. By treating a woven fabric as provided in step a with enzyme aggregates, advantageously cross-linked enzyme aggregates (CLEAs), a controlled and localized removal of the dye from the additional layer of the fabric may be performed. In this way, by means of the process of the invention, it is possible to change the appearance of the additional layer of the fabric, to provide a worn-out look to the fabric, without damaging the structure of the base layer of the fabric, i.e. the layer of the fabric that provides the mechanical properties of the fabric, such as tensile strength. For example, according to an embodiment of the invention, a woven fabric as provided in step a, can have both additional layer and base layer dyed, namely indigo dyed, advantageously ring-dyed. In this case, by contacting the fabric with cross-linked enzyme aggregates (CLEAs), it is possible to remove the dye from the additional layer, with limited effect on the base layer. Therefore, the dye is removed mainly from the additional layer, thus creating a visual contrast with the base layer, and a novel worn-out effect.

Moreover, the process of the invention allows to remove at least part of the dye from the additional layer of the fabric, without destroying or damaging it. In fact, it has been observed that using enzyme aggregates, such as CLEAs, instead free enzymes or instead of traditional stone-washing, it is possible to effectively and controllably treat a fabric as provided in step a, in order to obtain a worn-out look of the fabric, without damaging it; the process also results in a controlled removal of the dye from the base layer.

Without being bound to a specific scientific explanation, it has been observed that when generating enzyme "aggregates" such as cross-linked aggregates, which are larger than the free enzymes, and contacting the fabric as provided in step a with the "aggregates" instead of the free enzymes, it is possible to control the penetration depth of the aggregates into the fabric; therefore, by using enzyme aggregates such as CLEAs, according to an aspect of the invention, it is possible to obtain a stone-washed appearance substantially localized on the additional layer of the fabric, without damaging it.

For example, fabric structures suitable to be finished by means of a process according to the present invention are disclosed in patent application US2015/0038042 (see in particular paragraphs [0013], [0019]-[0027], [0030], [0031], [0033], [0049]-[0051], [0054], [0055], [0060], [0066], [0068]-[0071], [0075], [0076], [0078]-[0083], [0086], [0089]-[0117]) and in patent application US2013/0048140 (see in particular paragraphs [0007], [0010], [0013]-[0018], [0041]-[0046], [0048]-[0050], [0054]-[0059] and Examples 1, 3-8 and 10.) whose descriptions are incorporated herein by reference.

Another object of the present invention is a process for the finishing of a woven fabric (or of a garment), comprising the following steps:

i. providing a woven fabric comprising warp yarns and weft yarns, and a front side and a back side, wherein the warp yarns and/or the weft yarns comprise a mixture of natural fibers and synthetic fibers, wherein at least the natural fibers are dyed;

ii. contacting the woven fabric of step i with enzyme aggregates such as cross-linked aggregates (CLEAs).

Enzymes suitable for the above process are those previously disclosed with reference to the process of claim 1, i.e. enzymes suitable for the so called bio-stoning processes of the fibers. The natural fibers may be cotton fibers.

According to an aspect of the invention, the above defined woven fabric is contacted with the previously defined enzymes such as aggregates of enzymes which may be cross-linked enzyme aggregates (CLEAs), the dye is removed only from the natural fibers, thus providing a "partial" decoloration on the fabric, i.e. providing the removal of the dye only from the natural fibers included in the fabric. In other words, the warp yarns and/or the weft yarns of a woven fabric, as provided in step i of the process of the invention, are "mixed" yarns, i.e. yarns that comprise both natural and synthetic fibers in the same yarn.

By contacting the woven fabric with enzymes, it is possible to localize the removal of the dye only on the natural fibers, e.g. cotton, comprised in warp and/or weft yarns of the fabric, thus providing a woven fabric having an improved worn-out appearance, and a distinctive shade effect, previously not obtainable with known methods. Enzymes may be free enzymes but may be aggregates of enzymes, such as cross-linked enzyme aggregates (CLEAs).

In the present description, reference is made to the process being carried out on a fabric having mixed yarns; this definition includes the fabric present in an article, especially a garment or clothing article. In other words, the process claims of this application are directed to a process that is carried out on a fabric independently on the form of the fabric. An article, e.g. a garment, that comprises or that is made with the fabric is included in the scope of protection of the claims of this application.

A further object of the present invention is a woven fabric as obtainable through the above disclosed process of the invention. According to an aspect of the invention, a woven fabric as obtainable by means of the process of the invention, is a woven fabric which is "partially" decolored. The woven fabric comprises yarns including dyed first fibers, such as cotton fibers, and dyed second fibers, wherein dye has been partially removed from the first fibers and is present on the second fibers.

Still another object of the invention is a clothing article comprising a woven fabric as above defined.

Further objects of the present invention are thus a woven fabric, and a clothing article.

Still another object of the invention is a process for the finishing of a woven fabric, comprising the following steps:

providing a woven fabric comprising warp yarns and weft yarns woven together, at least part of the yarns being dyed;

and contacting the woven fabric with enzyme aggregates, to at least partially remove dye from at least part of the yarns of the fabric.

The yarns of the woven fabric comprise fibers that may be at least in part indigo dyed, and they may be ring-dyed.

The enzyme aggregates may be cross-linked enzyme aggregates (CLEAs). A further object of the invention is the use of CLEAs.

As used herein, the expressions "fabric" and "woven fabric" preferably refers to fabrics having specific structural features making them suitable to be finished by a process according to the invention; i.e. these expressions indicate a woven fabric as referred to in step a, or in step i of the above disclosed embodiments of the processes of the invention. However, the enzyme aggregates of the invention may be used on any fabric such as on a woven fabric.

A further advantage of the process of the invention is that, by using enzyme aggregates, which may advantageously be CLEAs, tensile strength of the fabric is substantially the same before and after the treatment with the enzyme aggregates. Without being bound to a specific scientific explanation, it can be hypothesized that the larger size of aggregates (such as CLEAs), compared to free enzymes, prevents the aggregates from penetrating deeply into the fabric, thus preserving the properties of the fabric, such as the tensile strength. As used herein, the expressions "aggregates", "cross-linked enzyme aggregates (CLEAs)" and "CLEAs", indicate a plurality of enzymes that are immobilized and/or held together in a known way. The enzyme aggregates may be "cross-linked enzyme aggregates", i.e. "CLEAs", i.e. aggregates held together by means of cross-links to form insoluble clusters (i.e. "aggregates"). Enzyme aggregates, including CLEAs, are known in the art; they can be formed by one or more types of enzymes, having one or more types of catalytic activity. In the following description reference to CLEAs is made for sake of simplicity, without however limiting the scope of the invention to cross-linked enzymes.

As used herein, the term "enzyme" refers to any kind of enzyme suitable to be used in the textile industry such as, for example, enzymes suitable to perform finishing processes on fabrics or garments. Exemplary classes of enzymes, suitable to form CLEAs according to the invention are hydrolases and oxidoreductases. Enzyme aggregates such as CLEAs, can be produced by techniques that are known in the art. For example, CLEAs can be produced by cross-linking enzymes with one or more cross-linking agents such as, for example, glutaraldehyde. An exemplary disclosure of methods to make enzyme aggregates can be found in application WO 97/01629 and in publication Podrepšek et al. (2012), Chemical Engineering Transactions: 27, 235-240.

Exemplary first fibers may be cotton and other natural fibers. As used herein, the term "natural fibers" refers to any kind of fiber that can be found in nature, i.e. to not-synthetic fibers, such as cotton, wool, silk, etc. Cotton is an advantageous embodiment. As used herein, the term "natural yarns" refers to yarns that are made of natural fibers.

Exemplary second fibers are synthetic fibers. As used herein, the term "synthetic fibers" refers to man-made fibers, including "semi-synthetic fibers". Exemplary synthetic fibers according to the invention are nylon, acrylic, polyester, lycra etc. As used herein, the term "synthetic yarns" refers to yarns made of synthetic fibers.

According to an embodiment of the invention, suitable enzyme aggregates such as CLEAs, comprise a plurality of different enzymes, for example a plurality of enzymes of different classes, and/or having different catalytic activities.

According to various embodiments, the aggregates, such as the cross-linked enzyme aggregates (CLEAs), comprise at least one enzyme selected from cellulase, laccase, glucose oxidase, pectinase, xylanase, peroxidase, catalase, protease and mixtures thereof. The enzyme aggregates may comprise at least one cellulase. For example, suitable cellulases are neutral cellulases, acidic cellulases and mixtures thereof.

Advantageously, contacting (i.e. treating) a fabric such as a fabric having an additional layer as disclosed in step a of the above mentioned process, with enzyme aggregates such as CLEAs, comprising cellulase, and/or laccase, and/or glucose oxidase, and/or pectinase, and/or xylanase, and/or peroxidase and/or protease and/or catalase allows the controlled removal of the dye from the additional layer of the fabric, and the production of a "stone-washed" effect (i.e. a "worn" or "used" or "worn-out" effect) mainly localized on the additional layer of the fabric.

According to another embodiment, the process of the invention is a process of "biostoning", wherein a fabric having yarns of mixed first and second fibers as provided in step i of the above discussed process, is contacted with aggregates such as CLEAs, comprising at least one enzyme selected from cellulase, laccase, glucose oxidase, pectinase, xylanase, peroxidase, catalase, protease or mixture thereof, in order to provide a "stone-washed" look to the fabric by the localized removal of the dye from the natural fibers comprised in the warp and/or weft yarns of the fabric.

As used herein, the term "biostoning" refers to a process of finishing fibers or fabrics using enzymes, that gives the finished textile product a stone washed appearance. As used herein, the expression "stone-washed look", "stone-washed appearance" and "stone-washed effect", refer to a fabric which has an appearance identical or similar to the appearance obtainable by washing the fabric with pumice stones, i.e. a used or worn-out appearance, wherein at least part of the fabric has lost at least part of its original color and appears aged and faded.

According to an aspect of the invention, the yarns used for the additional layer of the woven fabric are dyed differently from the yarns of the base layer. Namely, the yarns of the additional layer may be dyed to provide a different hue, or color, with respect to the dyed yarns of the base layer; e.g. the hue of the additional layer's yarns may be darker than the hue of the base layer's yarns. Thus, according to an aspect of the invention, the process of the invention allows to provide the additional layer with a different color or different shades of color with respect to the base layer.

In this way, it is possible to obtain a fabric where the "stone-washed" look is mainly obtained, or almost only obtained, on the additional layer, while the base layer maintains substantially the same aspect or an aspect similar to the aspect before the contact with CLEAs, i.e. a non-stone-washed look.

According to various embodiments, enzyme aggregates are selected from cellulase aggregates, laccase aggregates, glucose oxidase aggregates, pectinase aggregates, xylanase aggregates, peroxidase aggregates, protease aggregates, catalase aggregates and mixtures thereof.

The enzyme aggregates may be cellulase aggregates.

According to various embodiments, CLEAs are selected from cellulase CLEAs, laccase CLEAs, glucose oxidase CLEAs, pectinase CLEAs, xylanase CLEAs, peroxidase CLEAs, protease CLEAs, catalase CLEAs and mixtures thereof. In other words, the enzyme aggregates such as CLEAs, suitable to be used in a process according to the invention can be made, for example, entirely of cellulase ("cellulase aggregates" or "cellulase CLEAs"), laccase ("laccase aggregates" or "laccase CLEAs") or glucose oxidase (glucose oxidase aggregates" or "glucose oxidase CLEAs"), and the aggregates such as CLEAs, can be employed in the process of the invention alternatively, or mixed in any ratio.

According to various embodiments, the enzyme aggregates comprise different types of enzymes; in other words, a single aggregate can comprise various enzymes. The enzyme aggregates may advantageously comprise at least two enzymes selected from cellulase, laccase, glucose oxidase, pectinase, xylanase, peroxidase, catalase, protease, in any ratio. For example, an enzyme aggregate according to the invention can comprise a mixture of cellulases and laccases, or can comprise a mixture of cellulases, laccases and pectinases.

Advantageously, the enzyme aggregates such as CLEAs, are "specialized enzyme clusters", which may be specifically tailored in their features in order to obtain the desired effect on the fabric.

This fact provides for several advantages with respect to randomly cross-linked clusters of enzymes, according to the prior art.

For example, the enzyme aggregates may be designed in order to have a determined enzyme composition, mass (i.e. molecular weight) and activity. Advantageously, the enzyme aggregates may be designed to have determined structural and functional features, which can be pre-determined in view of the type of fabric to be treated with the aggregates, as well as in view of the final visual effect desired of the fabric.

According to various embodiments, the enzyme aggregates, which may be CLEAs, employed in the disclosed process have a size ranging from 1 μm to 100 μm, and the size may range from 1 μm to 50 μm or from 1 μm to 30 μm in various embodiments.

The size of the aggregates such as CLEAs, can be selected and adjusted in view of the structure of the fabric to be finished. For example, the size of the aggregates can be selected in view of the density and/or thickness of the over portions formed by a plurality of weft yarns, and/or in view of the final effect to be obtained such as, for example, the partial or complete removal of the dye from the additional layer.

According to various embodiments, the step b. (or step ii.) is carried out by washing the woven fabric with a solution containing the enzyme aggregates such as cross-linked enzyme aggregates (CLEAs).

According to various embodiments of the process of the invention, the step b. (or step ii.) is carried out at a pH ranging from 3.5 to 9.5, a pH ranging from 4.0 to 8.0 or a pH ranging from 4.5 to 7.0. In some embodiments, step b. (or step ii.) of the process of the invention is carried out at a pH of 4.8-5.0. The pH is selected and adjusted according to the nature of the enzymes to be used in the aggregates.

According to various embodiments of the process of the invention, the step b. (or step ii.) is carried out at a temperature ranging from 25° C. to 70° C. and in some embodiments, the temperature may range from 35° C. to 55° C. or from 45° C. to 55° C. In some embodiments, step b. (or step ii.) of the process of the invention is carried out at a temperature of 50° C.

According to various embodiments of the process of the invention, enzyme aggregates such as CLEAs, have an enzymatic activity ranging from 0.5 U/ml to 100 U/ml, an enzymatic activity ranging from 2 U/ml to 50 U/ml, or an enzymatic activity ranging from 5 U/ml to 20 U/ml, wherein one U/ml (enzyme unit/ml of solution comprising the aggregates) is the amount of enzyme (i.e. the amount of aggregates such as CLEAs) in one ml of solution comprising the aggregates that converts 1 μmol of substrate per min.

Each enzyme that can be used to prepare enzyme aggregates such as CLEAs, according to the invention, requires different method/approach to detect its activity; the different methods/approaches are known in the art.

For example, when the aggregates comprise one or more cellulase the generic method for detecting cellulase activity is based on the DNS assay, which is a method that is known in the art.

When the aggregates comprise at least one cellulase, the enzyme activity (U/ml) may be advantageously measured according to the method disclosed in <<Pure & Appl. Chem. Vol. 59, No. 2, pp. 257-268, 1987, *"Measurement of cellulase activities"*, section "VII: ADDITIONAL ASSAY PROCEDURE FOR ENDOGLUCANSE (HEC Assay) (ref. 9)">>.

According to embodiments of the invention, enzyme aggregates such as CLEAs, retain at least the 10% of the free enzyme activity. In some embodiments, enzyme aggregates such as CLEAs, retain at least the 50% or at least 70% of the free enzyme activity. For example, cellulase CLEAs according to the invention, retain at least the 10% of the free cellulase activity, or at least 40%, or even at least 70% of the free enzyme activity.

According to various embodiments of the process of the invention, the step b. (or step ii.) is carried out by contacting a fabric according to step a (or step i) with a composition comprising enzyme aggregates such as CLEAs, wherein the concentration of the aggregates in the composition ranges from 1 mg/g to 100 mg/g or from 10 mg/g to 70 mg/g, or from 15 mg/g to 50 mg/g, wherein the unit of measure "mg/g" is intended to be "mg of aggregates (e.g. CLEAs) for one g of fabric substrate".

Advantageously, the concentration, i.e. the use concentration, of the aggregates such as CLEAs, can be selected in view of other parameters such as, for example, the catalytic activity, i.e. the enzymatic activity, of the aggregates and/or the dimension of the aggregates, in order to obtain the desired final result, such as, for example, the desired "three-dimensional" worn-out effect, on the fabric.

According to various embodiments of the process of the invention, the step b. (or step ii.) is carried out for a contact time ranging from 10 min to 90 min, from 15 min to 50 min, or from 20 min to 30 min.

According to exemplary embodiments, the step b. (or step ii.) of the process, of the invention, i.e. contacting the woven fabric of step a (or step i) with enzyme aggregates such as cross-linked enzyme aggregates (CLEAs), can be performed in several different ways.

For example, a fabric according to the invention can be dipped into a solution containing the aggregates (e.g. CLEAs); alternatively, the aggregates can be sprayed onto the fabric.

According to various embodiments, the enzyme aggregates such as CLEAs, are coupled to magnetic nano-particles in a way known in the art. The use of aggregates coupled with magnetic nano-particles in the process of the invention is particularly advantageous because the aggregates coupled with magnetic nano-particles can be easily and quickly recovered after the end of the process of finishing. In this way, the enzyme aggregates such as CLEAs, can be reused, thus further reducing the costs of the process of finishing and providing further environment advantages, such as reducing the waste products of the process.

Advantageously, the coupling of aggregates with magnetic nano-particles, provides for enzyme aggregates that are magnetically controllable.

In other words, enzyme aggregates coupled with magnetic-nanoparticles may be controlled, e.g. "directed" or "moved", by providing a magnetic field.

For example, enzyme aggregates coupled with magnetic-nanoparticles may be moved, by means of a magnetic field, to specific areas of the fabric during the treatment of the fabric with the aggregates, so that the stone-washed effect is provided substantially only in the specific areas of the fabric where the aggregates have been moved.

According to embodiments, the enzyme aggregates such as CLEAs, are coupled to one or more additive.

According to embodiments, the enzyme aggregates are coupled to one or more additive, wherein the additive is selected from carbohydrates, proteins, polyols and mixtures thereof.

For example, the enzyme aggregates such as CLEAs, may be coupled to one or more carbohydrate (such as dextran and glucose), protein (e.g. BSA, i.e. bovine serum albumin) and polyols (e.g. PEG, i.e. polyethylene glycol) and mixtures thereof.

Advantageously, by coupling the aggregates with one or more of the above mentioned additives, it is possible to adjust the zeta potential of the aggregate, such that it is possible to adjust the interaction of the aggregate with the fabric, as well as the removal of the dye from the fabric, for example, by providing an electric field during the treatment of the fabric with the aggregates.

According to embodiments, the enzyme aggregates such as CLEAs, are coupled to at least one magnetic nano-particles and to at least one additive. According to various embodiments, the woven fabric of step a is a woven fabric having warp yarns, first weft yarns and second weft yarns, the warp yarns and the first weft yarns form a base layer of the fabric, and the second weft yarns extend to provide over portions along a side, e.g. the front side, of the fabric. According to various embodiments, the woven fabric of step a of the process of the invention has the second weft yarns that extend to form over portions along a side, e.g. the front side, of the fabric by floating over at least three warp yarns, and in some embodiments the second weft yarns float over at least five warp yarns, and or over at least seven warp yarns.

The length of the over portions formed by the second weft yarns is advantageously selected depending on the number of warp yarns to be passed, and/or in order to obtain over portions which can be more or less tightly woven to the base layer. In other words, in exemplary embodiments, the length of the over portions is selected in order to obtain an additional layer which is tightly associated to the base layer; in other exemplary embodiments, the length of the over portions is selected in order or to obtain over portions which hang loosely on the base layer so that they are droopy, thus obtaining an additional layer which is not tightly associated to the base layer. According to an exemplary embodiment of the invention, a fabric as provided in step a comprises at least one plurality of second weft yarns forming loose over portions, and/or at least one plurality of second weft yarns forming over portions tightly woven to the base layer.

According to various embodiments, the woven fabric of step a of the disclosed process has the second weft yarns that extend to form over portions along the front side of the fabric by passing over up to twenty warp yarns, more advantageously by passing over up to fifteen warp yarns, or by passing over a maximum of 12 warp yarns.

According to various embodiments, the woven fabric of step a of the disclosed process has the first weft yarns that extend to form under portions along the back side of the fabric by passing below two or more warp yarns, advantageously by passing below 5 or less warp yarns.

According to various embodiments, the woven fabric as provided in step a has two pluralities of second weft yarns.

According to embodiments of the invention, the woven fabric of step a has an average ratio "second weft yarns:first weft yarns" ranging from 1:1 to 2:1; in other words, for each first weft yarn in the fabric, there is an average number of second weft yarns ranging from 1 to 2.

According to various embodiments, the woven fabric is a denim fabric such as an elastic denim fabric. According to exemplary embodiments, the woven fabric is a denim fabric selected from "very light" denim fabric (having a weight of 5 ounces/square yard or less); a "medium light" denim fabric (having a weight ranging from 5 ounces/square yard to 8 ounces/square yard); a "normal" denim fabric having a weight ranging from 8 ounces/square yard to 12.5 ounces/square yard; a "heavy" denim fabric (having a weight over 12.5 ounces/square yard).

According to an embodiment, the woven fabric is provided in its natural color, i.e., not dyed, and can be dyed by known methods before being treated with the enzymes aggregates. According to further exemplary embodiments, warp yarns and/or weft yarns are dyed before the weaving into a fabric.

According to various embodiments, the warp yarns of the woven fabric have a linear density ranging from 118.2 tex (5/1 Ne) to 5.91 tex (100/1 Ne), or ranging from from 19.7 tex (30/1 Ne) to 8.44 tex (70/1 Ne) or from 13.13 tex (45/1 Ne) to 10,754 tex (55/1 Ne) or the warp yarns may have a linear density of warp yarns of 11.82 tex (50/1 Ne) on some embodiments, wherein "tex" is a known count unit used in the textile field and refer to the mass per unit length of textile yarns and threads (1 tex=$10^{-6}$ kg.m$^{-1}$), and wherein "Ne" is the English cotton number that is a known count unit used in the textile field.

In some embodiments, warp yarns are cotton yarns, for example, indigo dyed cotton yarns which may be ring-dyed cotton yarns.

According to some embodiments, the first weft yarns of the woven fabric have a linear density ranging from 118.2 tex (5/1 Ne) to 5.91 tex (100/1 Ne), but the linear density may range from 19.7 tex (30/1 Ne) to 8.44 tex (70/1 Ne) or from 13.13 tex (45/1 Ne) to 10.754 tex (55/1 Ne). In some embodiments; the linear density of first weft yarns is 11.82 tex (50/1 Ne).

In some embodiments, the linear density of the first weft yarns of the woven fabric is in the range 24,625 tex (24/1 Ne) to over 11,82 tex (50/1 Ne), or in the range 49.25 tex (12/1 Ne) to 14,775 tex (40/1 Ne), or in the range 73,875 tex (8/1 Ne) to 19.7 tex (30/1 Ne), or in the range 118.2 tex (5/1 Ne) to 24,625 tex (24/1 Ne).

According to exemplary embodiments, the count or linear density of the second weft yarns is in the range of 118.2 tex (5/1 Ne) to 5.91 tex (100/1 Ne) and the linear density may range from from 19.7 tex (30/1 Ne) to 8.44 tex (70/1 Ne) or from from 13.13 tex (45/1 Ne) to 10,754 tex (55/1 Ne) in some embodiments. The linear density of the second weft yarns is 11.82 tex (50/1 Ne) in some embodiments. In some embodiments, the count of the second weft yarns is in the range 24,625 tex (24/1 Ne) to over 11.82 tex (50/1 Ne), or in the range 49.25 tex (12/1 Ne) to 14,775 tex (40/1 Ne), or in the range 73,875 tex (8/1 Ne) to 19.7 tex (30/1 Ne), or in the range 118.2 tex (5/1 Ne) to 24,625 tex (24/1 Ne).

The same ranges apply for the yarns of the fabric having an additional layer of yarns, and for the yarns of the fabric having yarns of mixed first and second fibers. One fabric may have an additional layer made of yarns having mixed first and second fibers.

In embodiments of the invention, the first weft yarns and the second weft yarns of the woven fabric as provided in step a, are both natural yarns, i.e. yarns that are made of natural fibers, such as, for example, cotton fibers. In other embodiments of the invention, the first weft yarns of the woven fabric as provided in step a are synthetic yarns which may be thermoplastic yarns, in particular thermoplastic elastomeric yarns, and the second weft yarns are natural yarns. In still other embodiments, the first weft yarns are natural yarns, and the second weft yarns are synthetic yarns such as thermoplastic yarns and may be thermoplastic elastomeric yarns. The natural weft yarns may be cotton yarns such as indigo dyed cotton yarns.

According to various embodiments, the process of the invention further comprises a step of manufacturing an article from the woven fabric of step a (or step i) before step b. (or step ii.) is carried out.

The article may be a garment having an inner side and an outer side, and wherein the additional layer is located on the outer side of the garment.

According to various embodiments, the process of the invention further comprises the steps of weaving un-dyed yarns to provide a fabric, dyeing the fabric and treating the dyed fabric according to step b.

According to embodiments of the invention, the warp yarns and/or the first weft yarns and/or the second weft yarns of the woven fabric as provided in step a of the process of the invention comprise natural fibers and synthetic fibers. As above mentioned, objects of the invention are a process according to claim 20, a fabric according to claim 21 and a clothing article according to claim 22.

According to some embodiments, the woven fabric as provided in step i of the process of the invention has the same structure on the woven fabric provided in step a of the process, i.e. is woven fabric comprising warp yarns and weft yarns wherein the weft yarns comprise a plurality of first weft yarns and at least one plurality of second weft yarns, the warp yarns and the plurality of first weft yarns form a base layer of the fabric, and the at least one plurality of second weft yarns form an additional layer of the fabric in the form of over portions, the additional layer being located on the front side of the fabric, wherein the additional layer is at least partially dyed. In some embodiments, at least the second weft yarns comprise natural fibers and synthetic fibers, wherein at least the natural fibers are dyed.

Enzymes aggregates, especially CLEAs, may be used to treat woven fabrics in general. Another object of the invention is a process according to claim 23. According to embodiments, the step of contacting the woven fabric with enzyme aggregates is carried out at a pH ranging from 3.5 to 9.5, a pH ranging from 4.0 to 8.0 or a pH ranging from 4.5 to 7.0.

The pH is advantageously selected and adjusted according to the nature of the enzymes to be used in the aggregates.

According to various embodiments, the step of contacting the woven fabric with enzyme aggregates is carried out at a temperature ranging from 25° C. to 70° C., and the temperature may range from 35° C. to 55° C. or from 45° C. to 55° C. in various embodiments.

According to embodiments, the step of contacting the woven fabric with enzyme aggregates is carried out by contacting the fabric with a composition including enzyme aggregates, the concentration of the enzymes aggregates in the composition being in the range of 1 mg/g to 100 mg/g, e.g. from 10 mg/g to 70 mg/g, or from 15 mg/g to 50 mg/g.

According to embodiments, the step of contacting the woven fabric with enzyme aggregates is carried out for a contact time within the range of 10 min to 90 min and the contact time may range from 15 min to 50 min or from 20 min to 30 min in various embodiments.

As above mentioned, according to various embodiments, the enzyme aggregates such as CLEAs, are coupled to magnetic nano-particles, or coupled to an additive (selected from carbohydrates, proteins, polyols and mixtures thereof), or coupled to at least one magnetic nano-particle and to at least one additive.

The natural fibers are cotton fibers, more particularly indigo dyed cotton fibers, in various embodiments.

According to embodiments of the invention, natural fibers and yarns are "hard" fibers and yarns, i.e. have a smaller shrinkage ratio with respect to synthetic fibers and yarns, after being removed from the loom.

According to embodiments of the invention, synthetic fibers and yarns are "elastic" fibers and yarns, i.e. have a greater shrinkage ratio with respect to natural fibers and yarns, after being removed from the loom. Suitable elastic yarns are yarns containing elastomeric fibers. An "elastomeric fiber" is a fiber made of a continuous filament or a plurality of filaments which have an elongation at break of at least 100%, independent of any crimp. Break elongation may be measured e.g. according to ASTM D2256/D2256M-10(2015). An "elastomeric fiber" is a fiber that after being stretched to twice its length and held for one minute at the length, will retract to less than 1.5 times its original length within one minute of being released.

According to various embodiments, the process of the invention is carried out on a clothing article (i.e., a garment) comprising a woven fabric as provided in step a (or step i), i.e. a clothing article comprising a fabric as provided in step a (or step i) is contacted with enzyme aggregates, e.g. cross-linked enzyme aggregates (CLEAs).

The present invention also relates to a woven fabric as obtainable by a process according to the invention.

A woven fabric as obtainable by the process of the invention shows, for example, an "improved stone-washed appearance", possibly a "three-dimensional stone-washed appearance", due to the different effect of the finishing process of the invention on the additional layer with respect to the base layer of the fabric; in fact, the process of the invention, advantageously allows to remove the dye at least from the additional layer on the front side of the fabric, without substantially affecting the mechanical characteristics of the base layer.

The present invention also relates to a clothing article comprising a woven fabric as obtainable by a process according to the invention. According to an aspect of the invention, the the front side of the woven fabric is the external visible side (i.e. the outer side) when the clothing article (i.e. the garment) is worn, and the back side is the internal not visible side (i.e. the inner side) when the clothing article is worn.

According to embodiments of the invention, the front side of the woven fabric is the internal not visible side when the article is worn, and the back side is the external visible side when the article is worn.

BRIEF DESCRIPTION OF THE DRAWINGS

Further aspects and advantages of the present invention will be discussed more in detail with reference to the enclosed drawings, given by way of non-limiting example, wherein.

DETAILED DESCRIPTION

Figure 1:
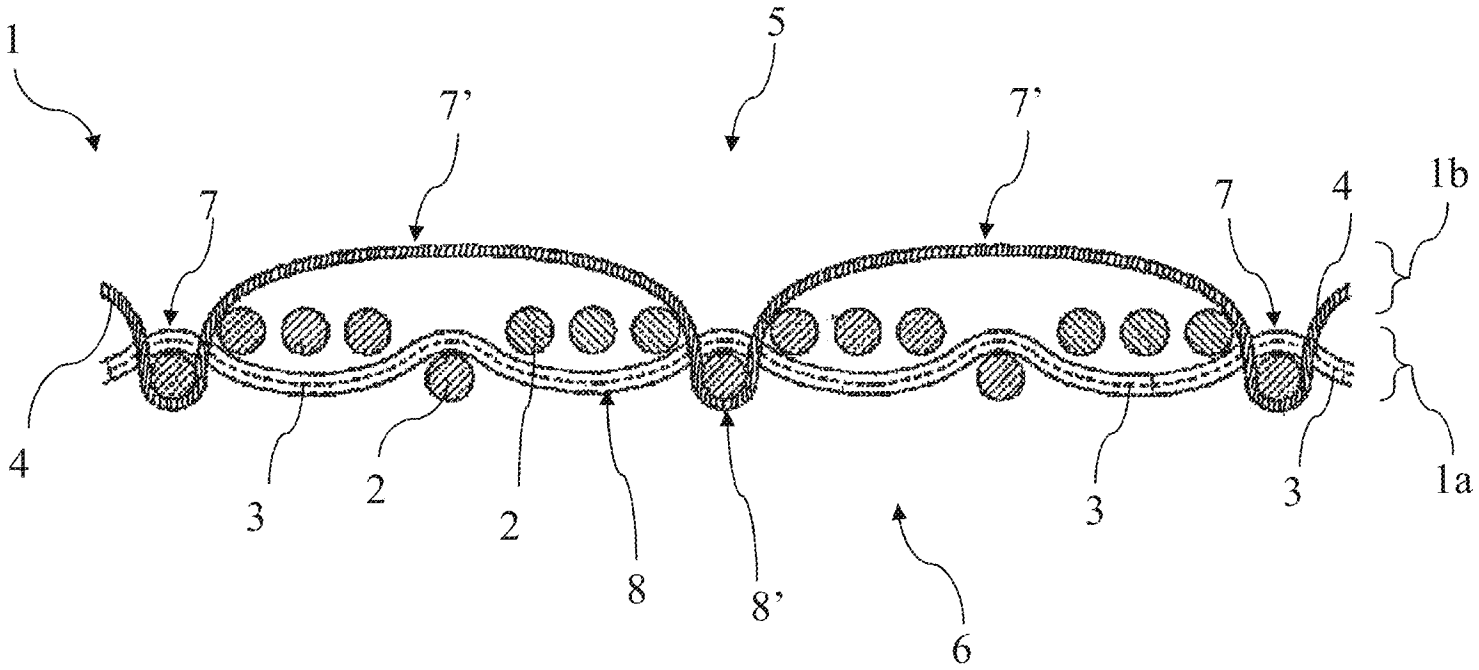
FIG. 1 is a cross-sectional view of a portion of a possible embodiment of a woven fabric, before the process of finishing according to the invention.

FIG. 1. shows a cross-sectional view of a portion of a possible embodiment of a woven fabric as provided in step a of the process according to the invention, before the process of finishing according to the invention is carried out.

In particular, FIG. 1 shows a woven fabric 1, wherein warp yarns 2, first weft yarns 3, and second weft yarns 4, are woven together in a pattern, to form the woven fabric 1 having a front side 5 and a back side 6.

The weft yarns 3,4 of the woven fabric 1, extend over and below the warp yarns 2, to provide correspondent over portions 7, 7' and under portions 8, 8', with respect to the warp yarns 2. As shown in FIG. 1, first weft yarns 3 form over portions 7 when they pass over the warp yarns 2, on the front side 5 of the fabric 1, and form under portions 8 when they pass below the warp yarns 2, on the back side 6 of the fabric 1.

Second weft yarns 4 form over portions 7' when they pass over the warp yarns 2, on the front side 5 of the fabric 1, and form under portions 8' when they pass below the warp yarns 2, on the back side 6 of the fabric 1.

According to an aspect of the invention, the front side 5 of the woven fabric 1 corresponds to the external visible surface of a clothing article comprising the woven fabric 1, when the article is worn.

In the embodiment shown in FIG. 1, first weft yarns 3 form over portions 7 by passing over one warp yarn 2 and form under portion 8 by passing below three warp yarns 2.

In the same embodiment, second weft yarns 4 form over portions 7' by passing over seven warp yarns 2 and form under portion 8' by passing below one warp yarn 2.

According to an aspect, the weft yarns of the woven fabric 1, comprise a plurality of first weft yarns 3 that are woven together with the warp yarns 2 to from a base layer 1*a* of the woven fabric 1, and at least one plurality of second weft yarns 4 forming an additional layer 1*b* of the fabric.

In the exemplary embodiment shown in FIG. 1, before undergoing a process of finishing according to the invention, the warp yarns 2 and the second weft yarns 4 are indigo dyed; therefore, the additional layer 1*b* is indigo dyed and the base layer 1*a* is substantially indigo dyed as well.

Figure 2:
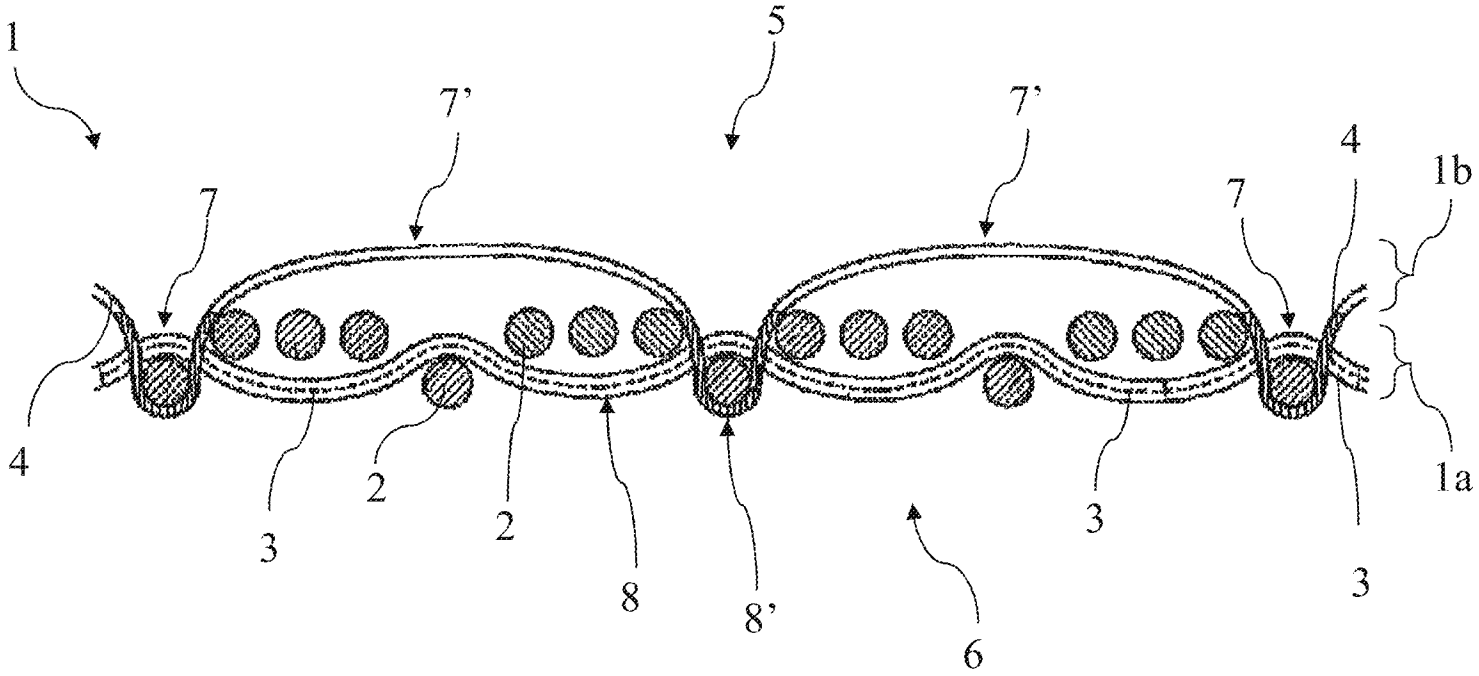
FIG. 2 is a cross-sectional view of the woven fabric of FIG. 1, after the process of finishing according to the invention.

FIG. 2 shows the same woven fabric 1 of FIG. 1, after the woven fabric 1 has undergone the process of finishing according to the invention.

FIG. 2 shows that the process of the invention, which comprises a step of contacting the woven fabric 1 with enzyme aggregates which may be cross-linked enzyme aggregates (CLEAs) allows the substantially localized removal of the dye, e.g. indigo dye, from the additional layer 1*b*, i.e. from the over portions 7' formed by the second weft yarns 4 on the front side 5 of the fabric.

The process of the present invention, advantageously, allows to remove the dye, e.g. indigo dye, from the additional layer 1*b*, without destroying or damaging it and, without substantially affect the base layer 1*a*, i.e. avoiding the undesired removal of the dye from the base layer 1*a*, e.g., from the warp yarns 2 (and/or from the first weft yarns 3) when such yarns are dyed.

In the exemplary embodiment of FIG. 2, is shown that the dye has been removed from the additional layer 1*b*, while the base layer 1*a* has not been affected by the finishing process, namely by the treatment with the enzyme aggregates. In particular, FIG. 2 shows that warp yarns 2 and the under portions 8' formed by the second weft yarns 4, after having been subjected to the process of the invention, are still dyed, i.e. indigo dyed.

According to an aspect of the present invention, by removing the dye from the additional layer 1*b* by contacting the woven fabric 1 with enzyme aggregates such as CLEAs, it is possible to obtain a woven fabric 1 having a worn-out look, i.e. a stone-washed effect, on the additional layer 1*b*, without destroying or damaging it and without substantially affecting the base layer 1*a*.

It has to be noted that, at least the second weft yarns 4 of the woven fabric 1 illustrated in FIG. 1 and FIG. 2 can comprise both natural fibers and synthetic fibers.

Figure 3:
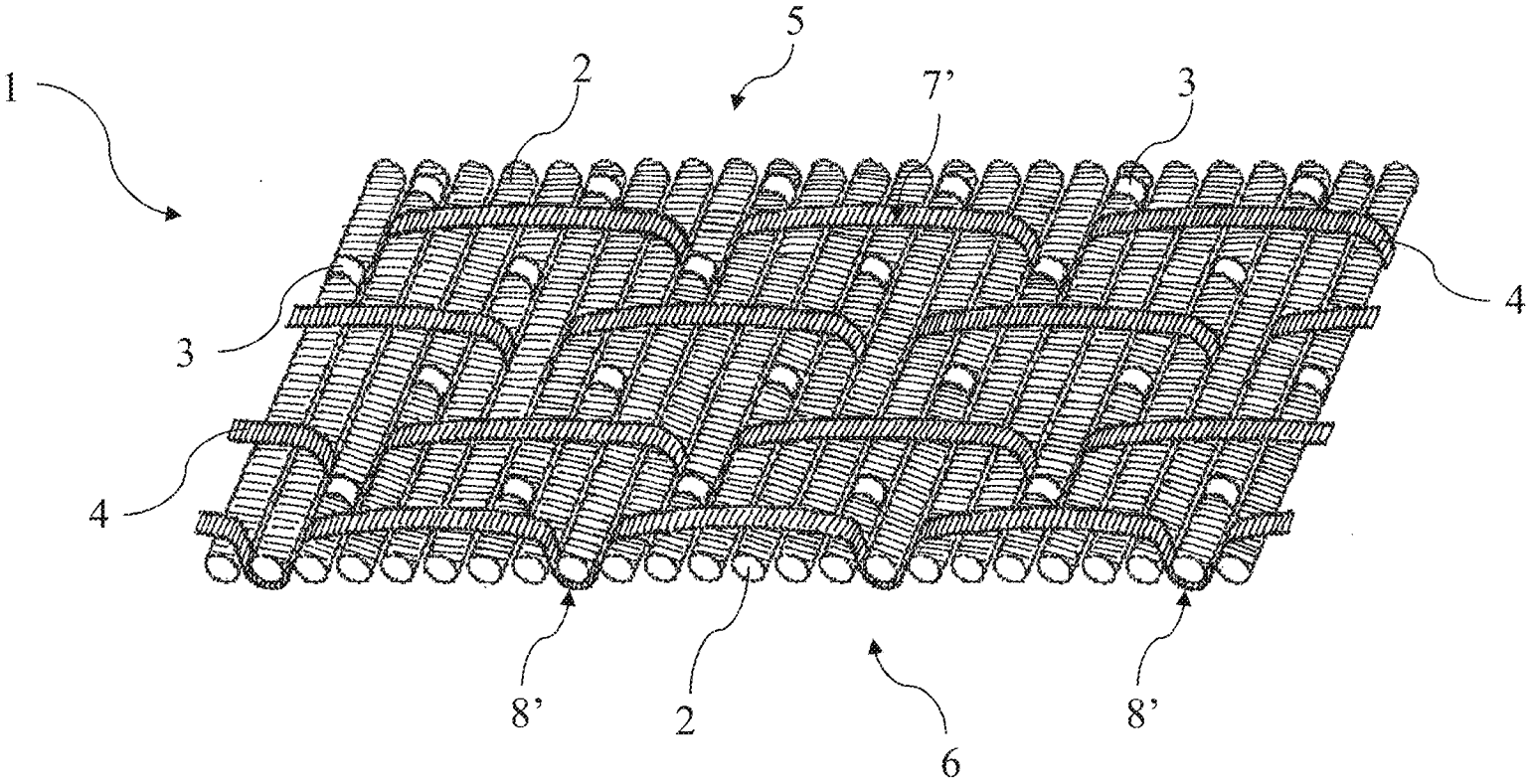
FIG. 3 is a perspective view of a portion of a possible embodiment of a woven fabric, before the process of finishing according to the invention.

FIG. 3 is a perspective view of a portion of an exemplary woven fabric 1, before undergoing the process of finishing according to the invention. FIG. 3 shows a portion of a woven fabric 1, which comprises a plurality of warp yarns 2, a plurality of first weft yarns 3 and a plurality of second weft yarns 4. Second weft yarns 4 form a plurality of over portions 7', on the front side 5 of the fabric, and form a plurality of under portions 8' on the back side 6 of the fabric.

The over portions 7' form an additional layer 1*b* on the front side of the fabric 1, not indicated in FIG. 3. As shown in FIG. 3, in the woven fabric 1, before being processed (i.e., treated) according to the invention, warp yarns 2 and second weft yarns 4 are dyed, in particular indigo dyed.

Figure 4:
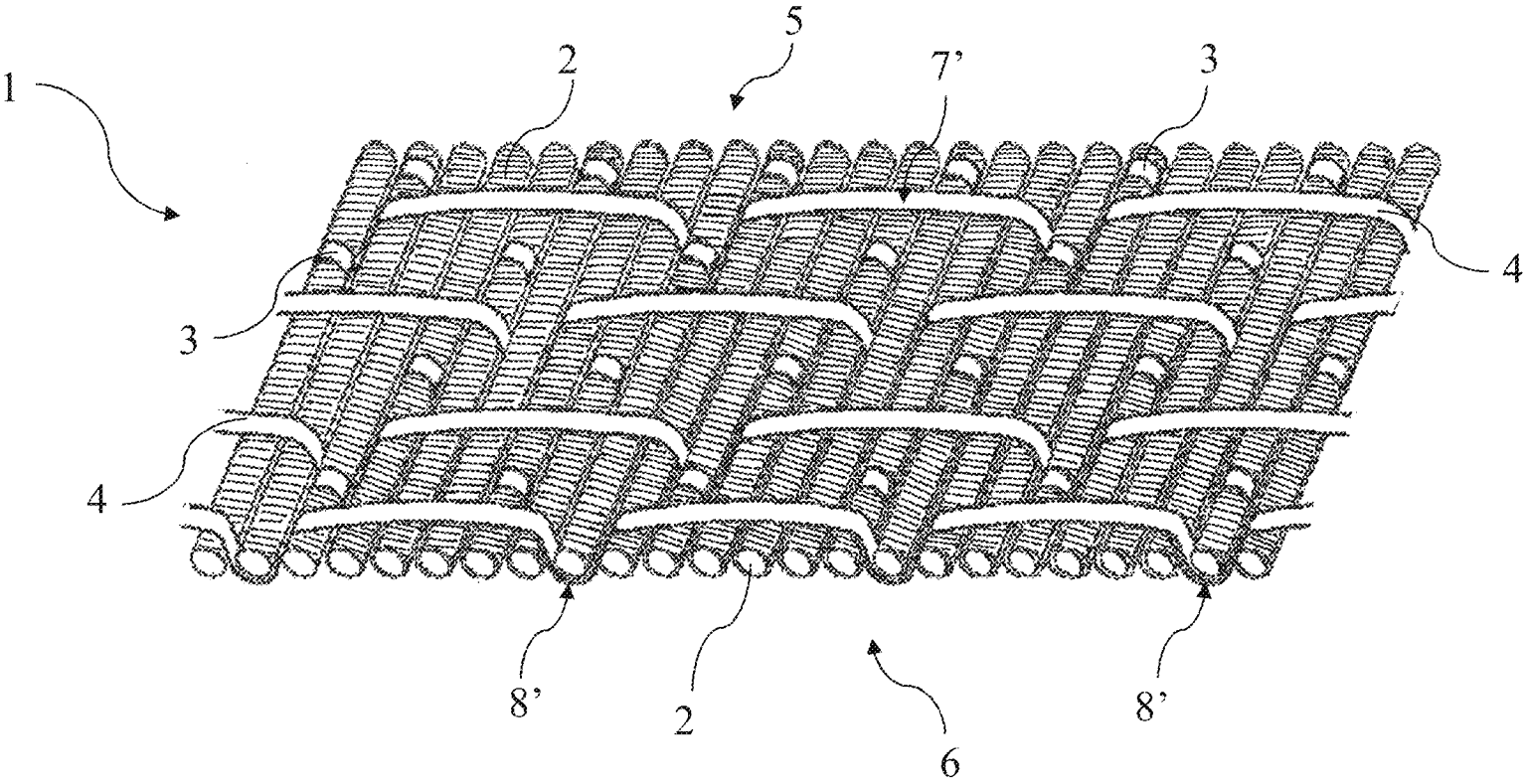
FIG. 4 is a perspective view of the portion of the woven fabric of FIG. 3, after the process of finishing according to the invention.

FIG. 4 is a perspective view of the portion of the woven fabric 1 of FIG. 3, after the process of finishing according to the invention has been performed. It can be observed in FIG. 4 that the process of the present invention, which comprises, as above mentioned, a step of contacting the woven fabric 1 with enzyme aggregates such as cross-linked enzyme aggregates (CLEAs), allows to remove the dye, e.g. indigo dye, from the over portions 7', which form the additional layer 1*b* (not indicated in FIG. 4), without damaging them, and without substantially affect the base layer 1*a*, i.e. without substantially remove the dye from the base layer 1*a*, e.g., from the warp yarns 2 and/or from the first weft yarns 3, when such yarns are dyed.

In the exemplary embodiment of FIG. 4, is shown that the dye has been removed from the additional layer 1*b* (not indicated in FIG. 4), formed by the plurality of over portions 7', while the base layer 1*a* (not indicated in FIG. 4), formed by the warp yarns 2 and the first weft yarns 3, has not been affected by the finishing process. It has to be noted that, at least the second weft yarns 4 of the woven fabric 1 illustrated in FIG. 3 and FIG. 4 can comprise both natural fibers and synthetic fibers.

Figure 5:
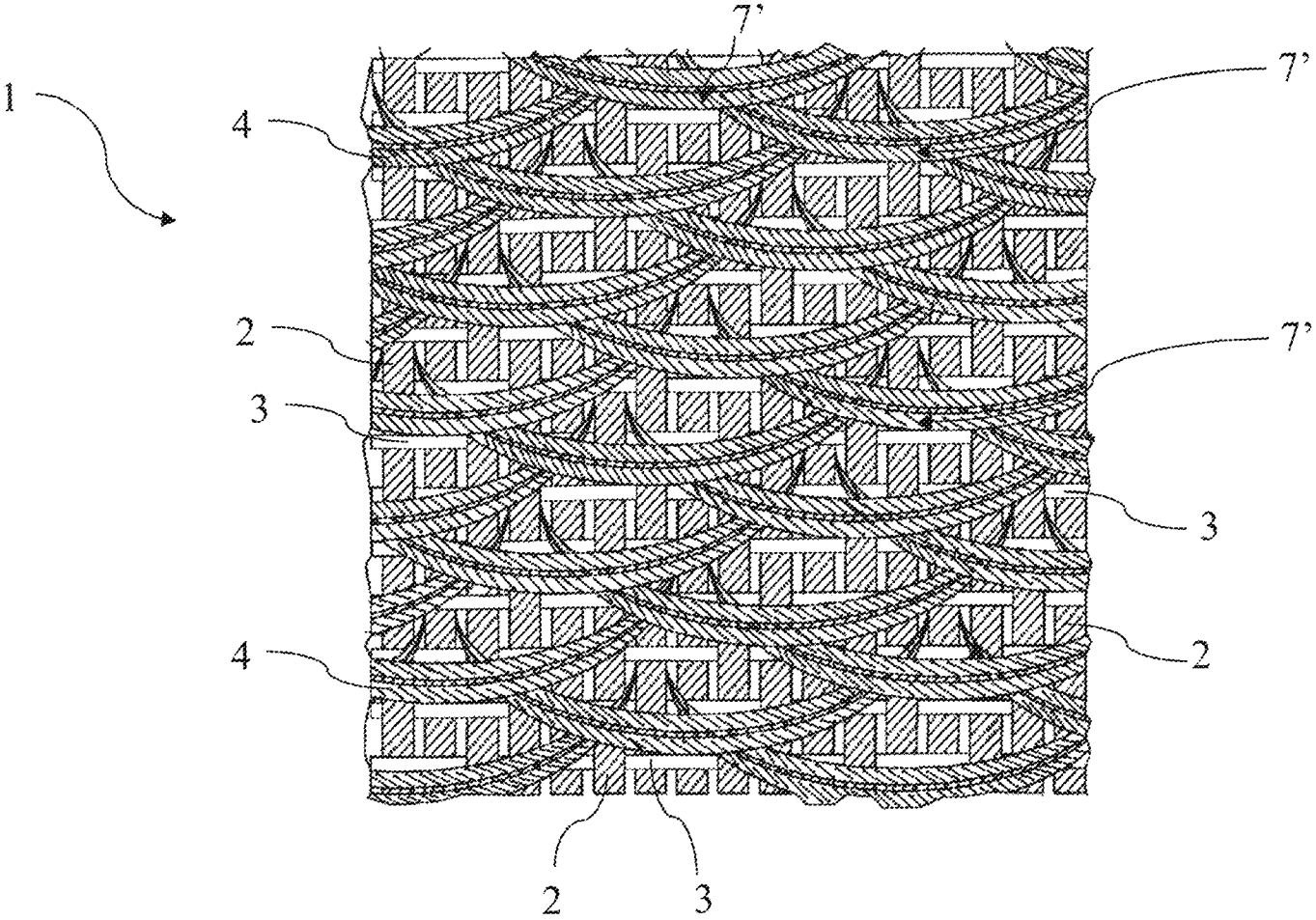
FIG. 5 is a schematic view of the front side of a possible embodiment of a woven fabric, before the process of finishing according to the invention.

FIG. 5 shows the front side 5 of an exemplary embodiment of a woven fabric 1, as provided in step a of the process of the invention, before undergo the finishing process of the present invention, i.e. before being contacted by enzyme aggregates.

The exemplary embodiment of the woven fabric 1, as shown in FIG. 5, comprises warp yarns 2, first weft yarns 3 and second weft yarns 4. The second weft yarns 4 form over portions 7', by passing over a determined number of warp yarns 2. In the exemplary embodiment of FIG. 5, two pluralities of second weft yarns 4 are present. In other exemplary embodiments (not shown in the figures) the same fabric of FIG. 5 (and FIG. 6) can have one plurality of second weft yarns.

In FIG. 5, the second weft yarns 4 form over portions 7' by passing over eleven warp yarns 2. Additionally, second weft yarns 4 of the exemplary embodiment of FIG. 5, are not tightly woven; as a result, the over portion 7' are loose and droopy, thus providing an additional layer 1*b* which is not tightly associated to the base layer 1*a*.

According to an aspect of the invention, the front side 5 of the woven fabric 1 corresponds to the external visible surface of a clothing article (i.e. a garment) comprising the woven fabric 1, when the clothing article is worn.

In the exemplary embodiment of FIG. 5, the second weft yarns 4 and the warp yarns 2 are dye, e.g. indigo dyed.

Figure 6:
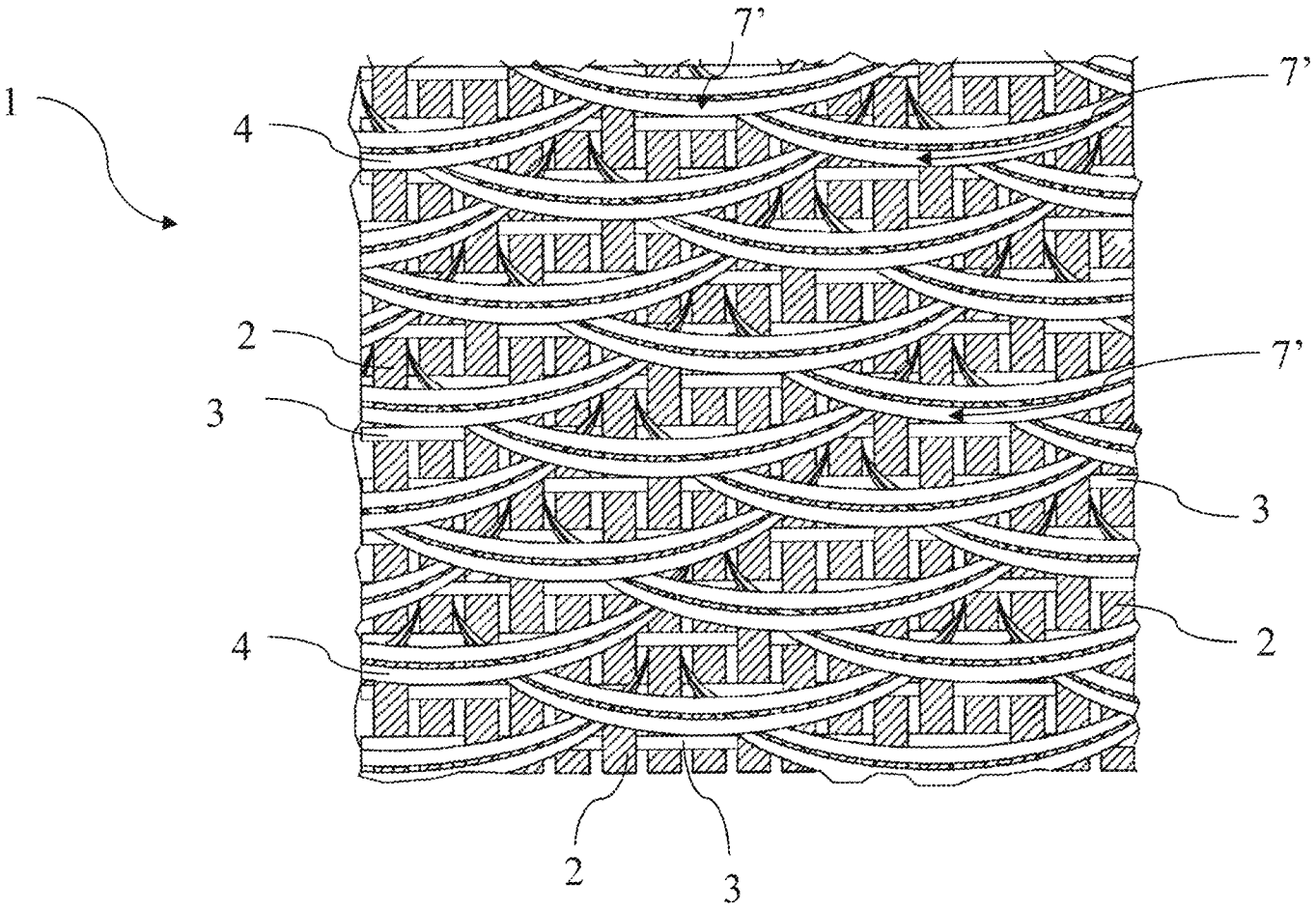
FIG. 6 is a schematic view of the front side of the woven fabric of FIG. 5, after the process of finishing according to the invention.

FIG. 6 shows the same woven fabric of FIG. 5, after the process of finishing according to the invention has been performed. As can be observed, by means of a process of finishing according to the invention, which comprises, as above mentioned, a step of contacting the woven fabric 1 with enzyme aggregates, e.g. cross-linked enzyme aggregates (CLEAs), the dye has been mainly removed from over portions 7'; conversely, warp yarns 2, remain substantially unaffected by the finishing process.

Advantageously, the process of the present invention, as above mentioned, allows to remove the indigo dye from the additional layer 1*b*, formed by over portions 7', without damaging it and, without substantially affect the base layer 1*a*, i.e. without substantially remove the dye from the base layer 1*a*, e.g., from the warp yarns 2. As a result, a stone-washed effect (i.e. a worn-out effect), can be obtained on the additional layer 1*b* of the woven fabric 1. Therefore, the dye is mainly removed from the additional layer 1*b*, thus creating a visual contrast with the base layer 1*a*, which is substantially not affected by the process of finishing of the invention, and which can be seen through the additional layer 1*b*, thus creating a "three-dimensional" worn-out effect.

It has to be noted that, at least the second weft 4 yarns of the woven fabric 1 illustrated in FIG. 5 and FIG. 6 can comprise both natural fibers and synthetic fibers.

Figure 7:
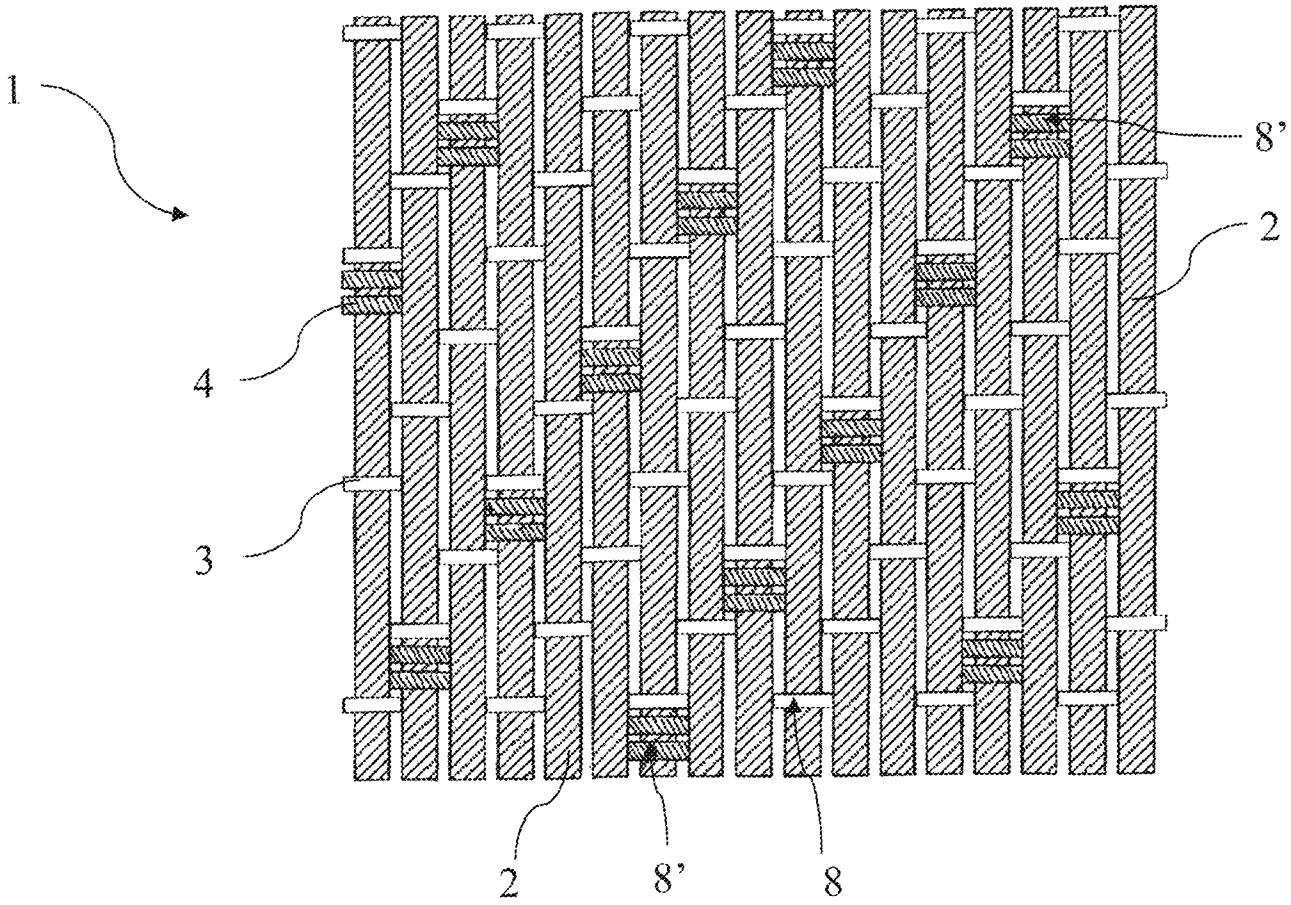
FIG. 7 is a schematic view of the back side of the woven fabric of FIGS. 5 and 6, both before and after the process of finishing according to the invention.

FIG. 7 shows the back side 6 of the woven fabric 1 of FIG. 5. In the embodiment illustrated in FIG. 7, the first weft yarns 3 form under portions 8 by passing under one warp yarn 2, as well as second weft yarns 4 which forms under portions 8' by passing under one warp yarn 2. As can be observed, the warp yarns 2 and second weft yarns 4, forming under portions 8' are dyed, while first weft yarns 3, forming portions under portions 8 are not dyed.

FIG. 7 represents the back side 6 of the woven fabric 1 of FIGS. 5 and 6, i.e. both before and after performing the process of the invention, namely both before and after the step of contacting the woven fabric 1 with enzyme aggregates. The process of finishing of the invention, which comprises, as above mentioned, a step of contacting the woven fabric 1 with enzyme aggregates, e.g. cross-linked enzyme aggregates (CLEAs), allows the removal of the dye from the additional layer 1*b* on the front side 5 of the fabric 1, while the base layer 1*a* and, in particular, the back side 6, are less or little affected by the process. In other words, the dye is substantially not removed from the base layer 1*a* and, in particular, from the back side 6 of the fabric 1, which does not substantially change appearance after the finishing process.

Example 1

Production of Fabric A

Figure 9:
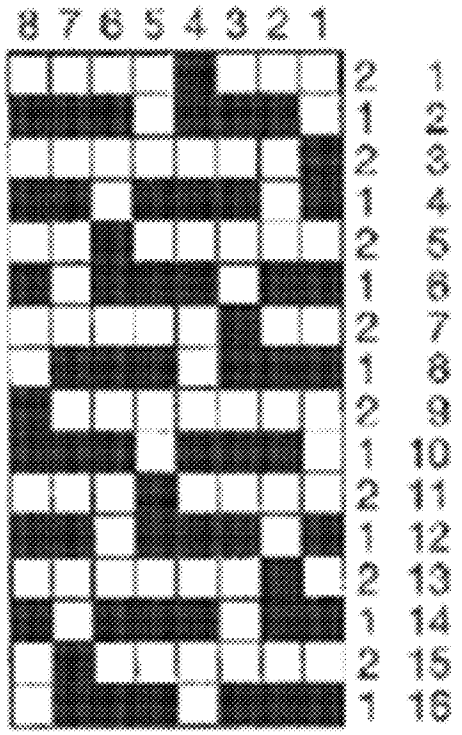
FIGS. 9 and 10 show the weaving pattern of the fabrics used for samples 4-6 and for samples 1-3, respectively.

A woven fabric was produced according to the weaving report of FIG. 9, with the following features:

Warp: 73,875 tex (Ne 8/1) Ring Slub Cotton
Weft 1: 84,43 tex (Ne 7/1) Ring cotton
Weft 2: 11,82 tex (Ne 50/1) Combed cotton
Warp density: 29.5 threads/cm
Weft density: 42.0 picks/cm Three samples of the fabric of example 1 are used to carry out three different treatments according to Examples 2, 3 and 4, respectively.

Comparative Example 2

Treatment with Pumice Stone

A sample of the fabric of Example 1, measuring 30 cm by 20 cm, is subjected to stone washing as follows: liquor ratio: 1:10, 150 gr of pumice stone for 1 kg of fabric, at 30° C. for 15 minutes. The result is shown in Sample 4 of FIG. 8.

Comparative Example 3

Treatment by Free Enzymes

A sample of the fabric of Example 1, measuring 30 cm by 20 cm, is subjected to treatment with free enzymes, namely free cellulase, as follows: 2 mg/ml solution of free enzyme for 1 kg of fabric, pH 4.8, at 50° C. for 30 minutes. The result is shown in Sample 5 of FIG. 8.

Example 4

Treatment with CLEAs

A sample of the fabric of Example 1, measuring 30 cm by 20 cm, is subjected to treatment with cellulase cross-linked enzyme aggregates, i.e. cellulase CLEAs, as follows: 20 mg/ml solution of CLEAs for 1 kg of fabric, pH 4.8, at 50° C. for 30 minutes. The result is shown in Sample 6 of FIG. 8.

Example 5

Production of Fabric B

Figure 10:
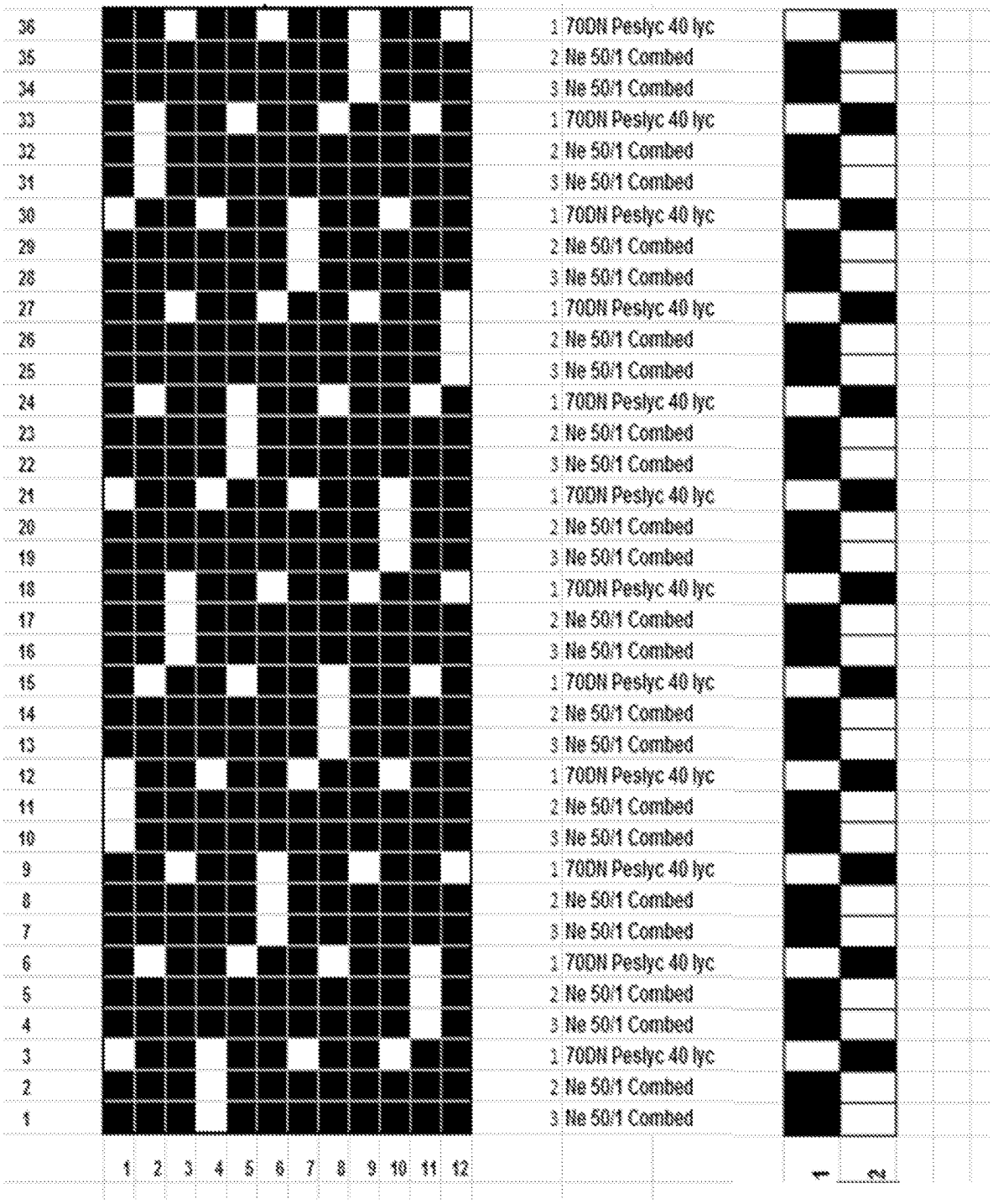

A woven fabric was produced according to the weaving report of FIG. 10, with the following features:

Warp1: 29.55 tex (Ne 20/1) Ring Cotton
Warp2: 29.55 tex (Ne 20/1) Ring Slub Cotton
Weft 1: 7.78 tex (70DN) Peslyc 40 lyc
Weft 2: 11.82 tex (Ne 50/1) Combed
Warp density: 33.1 threads/cm
Weft density: 54 picks/cm Three samples of the fabric of example 5 are used to carry out three different treatments according to Examples 6, 7 and 8, respectively.

Comparative Example 6

Treatment with Pumice Stone

A sample of the fabric of Example 5, measuring 30 cm by 20 cm, is subjected to stone washing as follows: liquor ratio: 1:10, 150 gr pumice stone for 1 kg of fabric, at 30° C. for 15 minutes. The result is shown in Sample 1 of FIG. 8.

Comparative Example 7

Treatment by Free Enzymes

A sample of the fabric of Example 5, measuring 30 cm by 20 cm, is subjected to treatment with free enzymes, namely free cellulase, as follows: 2 mg/ml solution of free enzyme for 1 kg of fabric, pH 4.8, at 50° C. for 30 minutes. The result is shown in Sample 2 of FIG. 8.

Example 8

Treatment with CLEAs

A sample of the fabric of Example 5, measuring 30 cm by 20 cm, is subjected to treatment with cellulase CLEAs as follows: 20 mg/ml solution of CLEAs for 1 kg of fabric, pH 4.8, at 50° C. for 30 minutes. The result is shown in Sample 3 of FIG. 8.

Figure 8:
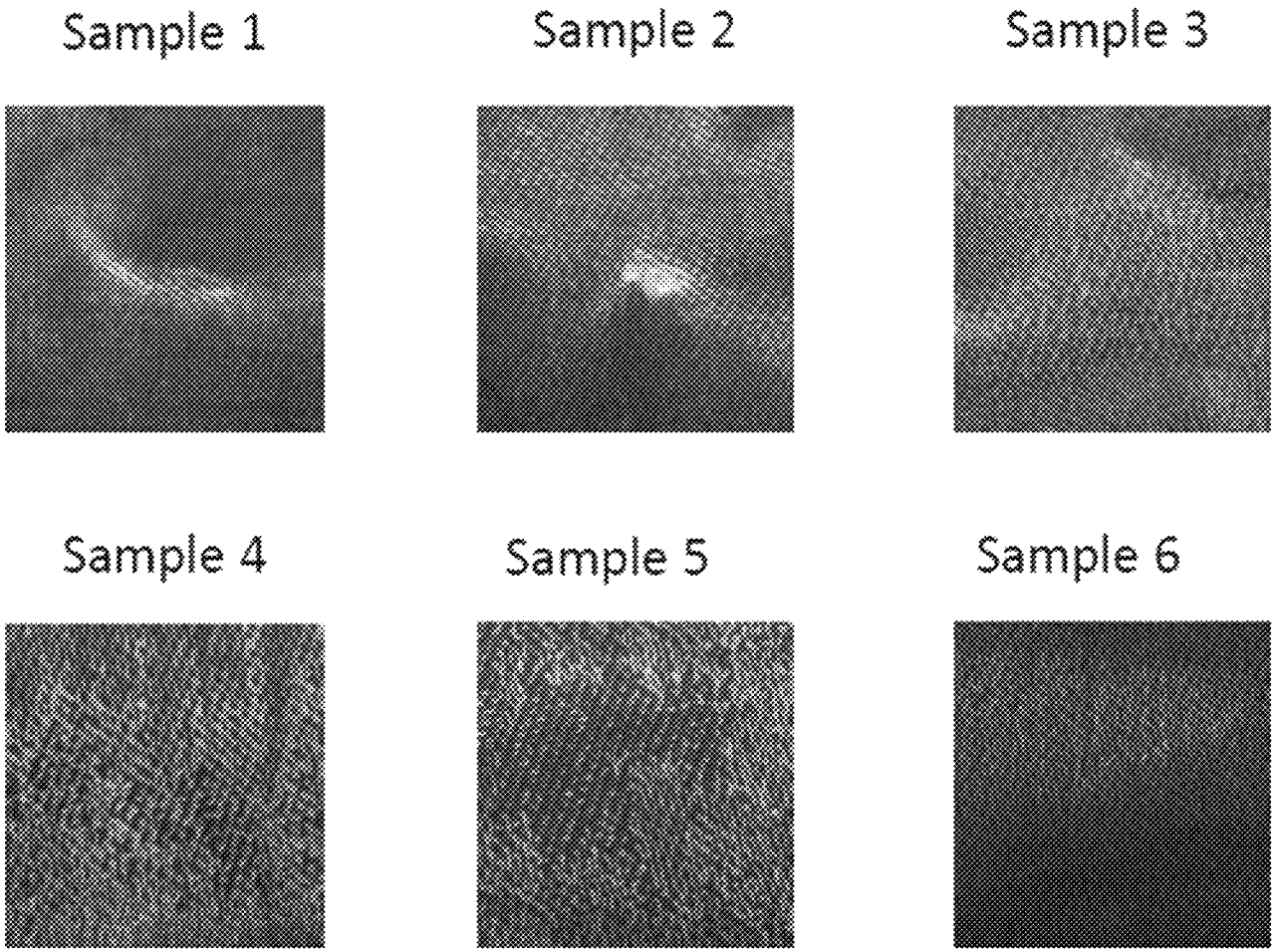
FIG. 8 are pictures of exemplary woven fabrics according to the invention which have been treated with different processes: "Sample 1" and "Sample 4" have been washed with pumice stone; "Sample 2" and "Sample 5" have been washed with free enzymes; "Sample 3" and "Sample 6" have been washed with cross-linked enzyme aggregates (CLEAs)

FIG. 8 shows the visual results of the processes in Examples 2-4 and 6-8. The finishing process of the invention is visible in Samples 3 and 6, the finishing by treatment with free cellulase is visible in Samples 2 and 5 and the finishing by washing with pumice stone is visible in Samples 1 and 4.

Samples 1-3 show that by treating a woven fabric of Example 5 with pumice stone (Sample 1) and free cellulase (Sample 2) cause the break of the additional layer of the over portions 7' of the woven fabric 1; the base layer 1*a* is also damaged and dye is removed from it. On the contrary, Sample 3 shows that the process of the invention carried out on the same woven fabric 1, allows the removal of the dye from the additional layer 1*b*, namely from the over portion 7'; the base layer 1*a* is only partly decolored by the enzyme aggregates (in this case, cross-linked enzyme aggregates of cellulases) without being damaged as it occurred in Samples 1 and 2.

Similar results were obtained by testing the woven fabric of Example 1; visual results are shown in Samples 4-6 of FIG. 8. Sample 4 and Sample 5 show that the treatment with pumice stone (Sample 4) and free cellulase (Sample 5) cause damages to the additional layer 1*b*, destroying over portion 7', of the woven fabric 1. Sample 6 shows that washing the same woven fabric 1 with cellulase CLEAs, allows the removal of the dye from the additional layer 1 b, namely from the over portion 7', without destroying or damaging it.

Example 9

Breaking Strength—Grab Method—Tensile Strength—ASTM D5034—Modified

The tensile strength of the fabrics of Example 1 and Example 5 before and after each treatment according to the Examples above illustrated was determined.

1. Scope

To determine the effective strength of the fabric in use, that is, the strength of the yarns in a specific width together with the additional strength contributed by adjacent yarns, the tensile strength was measured according to the standard ASTM D5034 (modified), as follows:

2. Apparatus.

2.1.—Tensile Testing Machine (CRE or CRT)

2.1.1.—CRE Instron Table Model 4411, microprocessor-based control console (or similar) with crosshead speed of 12±0.5 in./min.(305±10 mm/min)

2.1.2.—CRT Scott Model J with crosshead speed of 12±0.5 in./min.(305±10 mm/min)

2.1.3—Both testers fitted with A-420 pneumatic clamps with 1"×3"(25.4×76.2 mm) metal face anvil on back and 1"×1" (25.4×25.4 mm) rubber face anvil on front. Other combination of 1"(25.4 mm) wide anvil faces which allow for minimal slippage/jaw breakage of specimen may be used 3 Specimen Preparation.

3.1. Three specimens are prepared for each of the warp and filling directions. Cut each specimen 4±0.05" (100±1 mm) wide and at least 6" (150 mm) long with the long dimension parallel to the direction for which the breaking load is required.

3.1.1. Instead of cutting three single specimens in each direction, one continuous specimen of 12" (300 mm) by minimum of 6" (150 mm) in each direction may be cut.

3.1.2. Garment Testing: Samples should be taken from garment panels where appropriate space permits. If the garments have sandblast finishing on the panels, specimens must be taken from the sandblasted and non-sandblasted portions for testing.

3.2. Draw a line 1.5±0.02" (37±1 mm) from the edge of the specimen, parallel to the direction of the test used to center specimen in the clamps. No two specimens cut parallel to the warp should contain the same set of warp ends, and no two specimens parallel to the filling should contain the same set of filling picks.

3.3. Samples should be taken no nearer to the selvage than one tenth of the width of the fabric.

4. Procedure.

4.1. Condition all test specimens in the standard atmosphere for an appropriate period depending on the fiber content of the sample.

4.2. Prepare apparatus—check the zero point of the scale prior to each series of tests. Check distance between clamps at start of test set at 3±0.05" (76±1 mm). For the Instron 4411 or similar model, follow the instructions in the manual.

4.3. Select a load range of the testing machine such that the break occurs between 10% and 90% of full scale load.

4.4. Insert the test specimen in the clamps so that the line drawn on the sample running parallel with the direction of the test is adjacent to the side of the upper and lower jaw.

4.5. Operate the machine and read the breaking load. If a specimen slips in the jaws, breaks in the jaws or if the result falls markedly below the average for the set of specimens, discard the result and take another specimen.

4.5.1 Criteria for a jaw break is any break occurring within 0.25" (5 mm) of the jaw which results in a value below 50% of the average of all the other breaks.

5. Report.

5.1 Fabric testing—Report the average of three specimens in each direction to the nearest 0.5 kg (1 lb).

5.2 Garment testing—Report the average of the set of specimens of sandblasted portion, and non-sandblasted portion in warp and fill direction to the nearest 0.5 kg (1 lb).

Results

TABLE 1

| Tensile strength - warp direction (g): | | | | |
|---|---|---|---|---|
| | No treatment | Pumice stone | Free cellulase | CLEAs |
| | | Sample 1 | Sample 2 | Sample 3 |
| Example 5 | 99.43 | 84.75 | 86.33 | 99.32 |
| | | Sample 4 | Sample 5 | Sample 6 |
| Example 1 | 65.62 | 33.49 | 46.88 | 64.06 |

In Table 1, it can be observed that, with regard to both the fabrics of Example 5 and Example 1, the treatments of the fabric with pumice stone or free cellulase cause a reduction in the tensile strength of the fabric; in other words, the fabric results to be weaker after the treatment with pumice stone or free cellulase.

On the contrary, the results reported in Table 1 indicate that the treatment of the fabrics of Example 5 and Example 1 does not substantially affect (i.e. does not substantially reduce) the tensile strength of the fabric, which remains substantially the same both before ("No treatment") and after the treatment with CLEAs.

TABLE 2

| Tensile strength - weft direction - (KgF) | | | | |
|---|---|---|---|---|
| | No treatment | Pumice stone | Free cellulase | CLEA |
| | | Sample 1 | Sample 2 | Sample 3 |
| Example 5 | 48.29 | 41.42 | 39.67 | 46.89 |
| | | Sample 4 | Sample 5 | Sample 6 |
| Example 1 | 49.45 | 23.91 | 48.58 | 49.42 |

Similarly to the results of Table 1, also the results reported in Table 2 show that the tensile strength (in this case, along weft direction) of both the fabrics of Example 5 and Example 1, is reduced by the treatment of the fabric with pumice stone or free cellulase.

Conversely, the tensile strength of the fabrics of both Example 5 and Example 1 is not substantially affected by treatment with CLEAs; in other words, the tensile strength of the fabric, remains substantially the same both before ("No treatment") and after the treatment with CLEAs.

As can be observed from the Tables here above reported, the treatment with CLEAs provides for the highest preservation of tensile strength of the fabric, in comparison with pumice stone and free cellulase, in all the tests that were carried out.

In particular, taking into account the results concerning both warp (Table 1) and weft (Table 2) parts, it can be observed that pumice stone and free enzyme have a more destructive effect on fabric than CLEAs.

The invention claimed is:

1. A process for finishing a woven fabric, said process comprising:

providing a woven fabric comprising warp yarns and first weft yarns woven together to form a base layer of said woven fabric, and wherein a plurality of second weft yarns form an additional layer of said woven fabric in the form of over portions of yarns, said additional layer being located on at least one side of the woven fabric, wherein said plurality of yarns of said additional layer comprise fibers that are at least partially dyed, and wherein said warp yarns are dyed; and contacting said woven fabric with enzyme aggregates, to at least partially remove dye from at least said plurality of yarns of said additional layer; wherein said enzyme aggregates are cross-linked enzyme aggregates (CLEAs) having a size within the range of 1 μm to 100 μm, and wherein dye is removed from said additional layer and not substantially removed from said base layer, and wherein said over portions are not destroyed.

2. The process according to claim 1, wherein said plurality of yarns of said additional layer comprise cotton fibers that are at least in part indigo dyed.

3. The process according to claim 1, wherein said plurality of yarns of said additional layer comprise cotton fibers and said enzyme aggregates comprise at least one enzyme selected from the group consisting of cellulase, laccase, glucose oxidase, pectinase, xylanase, peroxidase, protease, catalase and mixtures thereof.

4. The process according to claim 1, wherein said contacting is carried out at a pH ranging from 3.5 to 9.5.

5. The process according to claim 1, wherein said enzyme aggregates have an enzymatic activity ranging from 0.5 U/ml to 100 U/ml.

6. The process according to claim 1, wherein said contacting includes contacting said woven fabric with a composition including said enzyme aggregates, said composition including a concentration of said enzymes aggregates in the range of 1 mg/g to 100 mg/g.

7. The process according to claim 1, wherein said enzyme aggregates are coupled to magnetic nano-particles.

8. The process according to claim 1, wherein said enzyme aggregates are coupled to one or more additives selected from the group consisting of carbohydrates, proteins, polyols and mixtures thereof.

9. The process according to claim 1, wherein said enzyme aggregates are coupled to at least one magnetic nano-particle and to at least one additive selected from the group consisting of carbohydrates, proteins, polyols and mixtures thereof.

10. The process according to claim 1, wherein said over portions of said yarns include said second weft yarns along a side of said woven fabric and float over a number of said warp yarns ranging from five to fifteen.

11. The process according to claim 1, wherein at least some of said weft yarns of have a linear density ranging from 118.2 tex (5/1 Ne) to 5.91 tex (100/1 Ne).

12. The process according to claim 1, further comprising manufacturing an article from said woven fabric prior to said contacting.

13. The process according to claim 12, wherein said article is a garment having an inner side and an outer side, and wherein said additional layer is located on the outer side of said garment.

14. The process according to claim 1, further comprising weaving un-dyed yarns to provide said woven fabric, then dyeing said woven fabric to produce a dyed woven fabric and wherein said contacting comprises contacting said dyed woven fabric.

15. The process according to claim 1, wherein the dyed yarns of the woven fabric are ring-dyed.

* * * * *